US008047019B1

(12) United States Patent
Tillery

(10) Patent No.: US 8,047,019 B1
(45) Date of Patent: Nov. 1, 2011

(54) ATTACHMENT TO CONVERT A BROOCH TO A PENDANT

(76) Inventor: David Allen Tillery, Bay Minette, AL (US)

( * ) Notice: Subject to any disclaimer, the term of this patent is extended or adjusted under 35 U.S.C. 154(b) by 453 days.

(21) Appl. No.: 12/011,376

(22) Filed: Jan. 25, 2008

Related U.S. Application Data

(60) Provisional application No. 60/899,419, filed on Feb. 5, 2007.

(51) Int. Cl.
*A44C 1/00* (2006.01)

(52) U.S. Cl. ..... 63/1.17; 63/20

(58) Field of Classification Search ..... 63/1.11, 63/1.17
See application file for complete search history.

(56) References Cited

U.S. PATENT DOCUMENTS 992,659 A * 5/1911 Hartoch ..... 24/367.1
2,225,890 A * 12/1940 Schwarzkopf ..... 63/1.16
2,274,269 A * 2/1942 Jellinek ..... 63/1.17
2,357,782 A * 9/1944 Rubin ..... 63/20
2,548,140 A * 4/1951 Bohlinger ..... 63/1.17
3,850,010 A * 11/1974 Noto ..... 63/1.16
4,276,757 A * 7/1981 Boening ..... 63/1.11
4,377,939 A * 3/1983 Reinsdorf ..... 63/3
5,245,844 A * 9/1993 Panzer ..... 63/1.16
5,921,110 A * 7/1999 Middendorff et al. ..... 63/1.11
7,120,974 B2 * 10/2006 Suganuma ..... 24/708
7,225,638 B2 * 6/2007 Loeff et al. ..... 63/12
D556,620 S 12/2007 Chan

* cited by examiner

*Primary Examiner* — Jack W. Lavinder

(57) ABSTRACT

An attachment for a brooch enabling said brooch to be suspended by a necklace as a pendant. The attachment comprises a body, a head, and a tail. The body contains multiple pin holes one of which encases the pin of the brooch. After the width is adjusted, said body lies adjacent to the hinge and the locking device of the pin. The proximity of said body to said devices as well as said body's thickness prevents said devices from contacting the wearer. The head, which houses the necklace hole, is of sufficient thickness that it creates a protective space between any sharp projections on the back of said brooch and the wearer above the pin. The tail, after adjustment, covers sharp projections below the pin. The attachment will protect the wearer from injury, make the brooch comfortable to wear, and display the brooch in a cosmetic manner.

4 Claims, 8 Drawing Sheets

ATTACHMENT TO CONVERT A BROOCH TO A PENDANT

CROSS-REFERENCE TO RELATED APPLICATIONS

This application claims the benefit of a Provisional Patent Application (Appl. No. 60/899,419) filed Feb. 5, 2007 by the present inventor.

FEDERALLY SPONSORED RESEARCH

N/A

SEQUENCE LISTING OR PROGRAM

N/A

BACKGROUND OF THE INVENTION

Field of Invention

My invention relates to an attachment to the back of a brooch (also spelled broach) that will allow the brooch to be worn as a pendant.

Brooches are pieces of jewelry designed to be worn on clothing. They are often referred to as "pins" because they have a pin on the back side that pierces the clothing and is locked into place with a locking device (FIG. 1).

Attempts have been made in the past to make brooches available as pendants. Some brooches were made with hooks on the back so that they would hook over a necklace. Hooks were not widely accepted because the brooch would often slip off the hook and be lost. And if hooks were soldered on at a later date, the value of the piece was diminished. Any physical permanent alteration to the brooch reduced it's value dramatically. Therefore, few people who valued their jewelry would add a hook so that it could be worn as a pendant.

Still, other attempts were made by soldering two metal tubes together or by soldering two metal rings on a tube. One of the tubes would be smaller and would fit over the pin of the brooch and the other one would be larger and would serve to contain the necklace. In the case of the rings, a ring would be soldered on each end of the smaller tube and the two rings would serve to contain the necklace. All these were custom made and required the expertise of a jewelry or some similar craftsman. These types of devices were not well received because they tended to rotate about the pin unless specially braced. Being made of metal, these tubes could easily alter the color of the brooch if there were open spaces so that light could pass.

My invention is an attachment for the back of a brooch make from a polymer. It can be purchased by the owner of the brooch and adjusted by them to fit. Help from another party is not required. My invention, being made of a polymer, is preferably clear; or it can be shaded to compliment the color of the brooch.

Brooches typically are made with a hinged pin on the back. The pin closes into a locking device and is secured in that locking device with a latch (FIG. 1). The pin can run horizontally, vertically, or at a slant. My invention is designed for a horizontal pin. If the brooch is placed on it's face, the slot in the locking device generally slants upward and backward toward the top of the brooch at an angle. When worn on the clothing, the weight of the broach forces the pin up and into the locking device helping to secure it. The brooch is further secured by closing the locking device's latch over the pin (FIG. 5). The pin can be of various lengths depending on the size of the brooch and can be positioned at various distances from the top of the brooch.

My invention is composed of a head, a body, and a tail (FIG. 2). The head has a necklace hole (of any size or shape) through which the necklace (a chord, chain, ribbon, rope, or any similar material that will support the pendant) will pass (FIG. 2). The body has one or more pin holes (of any size or shape) through which the pin of the brooch will pass. If made with multiple pin holes, my invention can be positioned closer or further from the top of the brooch depending on which pin hole is selected. To accommodate any size brooch, the body can contain any number of pin holes (FIG. 2). The tail is thin and is turned down at a sharp angle relative to the body (FIG. 2). The tail is made thin and of a material that it will flex when my invention is engaged on the back of a brooch.

When the pin of the broach is inserted into one of the pin holes of the body and the pin is allowed to close passively, the pin will not close all the way down to the locking device but will be positioned above it (FIG. 4). As pressure is applied to the back of my invention, the tail will flex. The pin is pushed down and engaged in the locking device. The tendency of the tail to return to it's unflexed shape will pull the pin up into the slot in the locking device and secure it. The latch on the locking device is then closed to further secure the pin (FIG. 5). When the pin is released from the locking device, the flexed tail will straighten as my invention once again assumes it's passive position above the locking device. My invention can be made from any polymer that will allow the tail to flex.

When my invention is engaged on the back of the brooch, the pin of the brooch will be in the locking device and the latch will be closed. The tail will be flexed, the head will be touching the back of the brooch above the pin, and the tail will be touching the back of the broach below the pin. My invention will not rotate about the pin and will be secure on the back of the brooch.

Since brooches are generally of an indeterminate shape, my invention was designed in a standard shape to be trimmed and customized for each individual brooch. All that is needed is a knife or a pair of scissors (FIG. 9).

My invention is wide enough to span the full length of the pin in most brooches. Should my invention be wider than the pin is long, then the full width (from the top of the head to the bottom of the tail) is trimmed so that it fits the pin when in the locked position.

The tail is longer than needed so that it will initially extend below the bottom of the brooch. At initial placement, when the my invention is locked in place, the tail is marked, removed, and trimmed to fit so that it touches at the bottom of the brooch and closely conforms to the shape of the brooch. The head may also be trimmed so that it closely conforms to the shape of the brooch (FIG. 9).

The Pin-to-Pendant should be removed when not in use to prevent permanent deformation of the tail.

Objects and Advantages

My invention is an attachment to the back of a brooch that will allow that brooch to be worn as a pendant. The attachment does not require the services of a jeweler or any similar craftsman but can be adjusted to fit by almost anyone with only a knife or a pair of scissors. Since the attachment is braced both above and below the pin on the back of the brooch, rotation about the pin cannot occur. Thus, the brooch can be worn as a pendant without fear of it rotating forward and hanging face down.

SUMMARY

My invention is an attachment that will allow a brooch to be worn as a pendant. It is made of a polymer rather than metal. Therefore, it can be adjusted by virtually anyone with a knife or a pair of scissors. It is preferably clear so as not to alter the color of the brooch. When engaged, it is braced above and below the pin on the back of the brooch, preventing any rotation about the pin. And with multiple holes in the body of the apparatus, the necklace hole can be positioned as close to the top of the brooch as desired, thereby making the appearance of the pendant more cosmetically pleasing. My invention is a distinct improvement over any device previously constructed to allow a brooch to be worn as a pendant.

DRAWINGS

Figures

Figure 4:
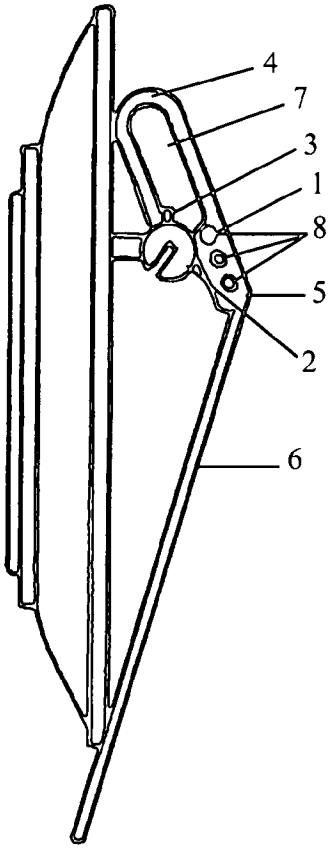

FIG. 4 is a view of my invention resting passively on the back of the brooch. The pin of the brooch is inserted into the pin hole closest to the head of my invention. The head of the pin in not engaged in the locking device. The latch of the locking device is open. The tail is not flexed. The tail has not been trimmed.

Figure 1:
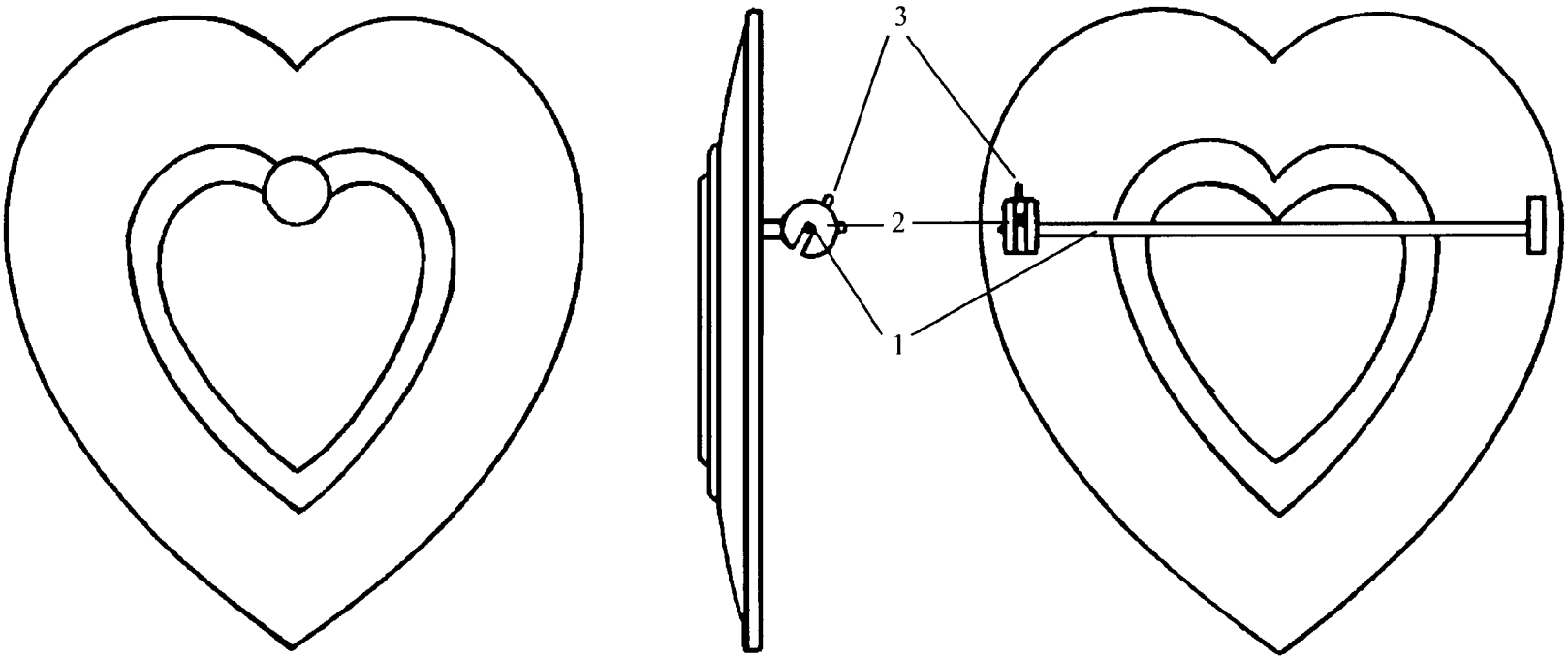
FIG. 1 is a standard brooch illustrating the pin closed into the locking device and the latch closed.
Figure 2:
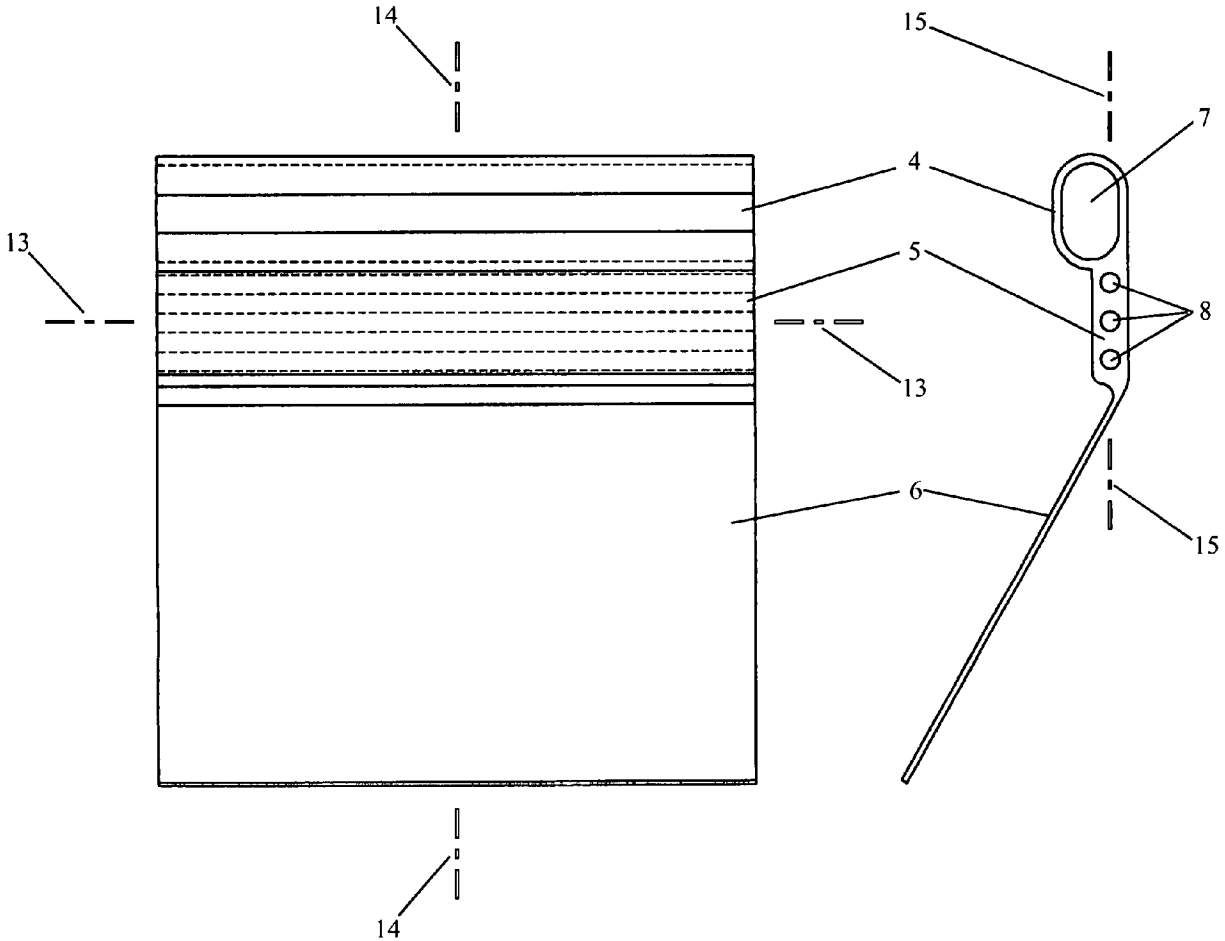
FIG. 2 is a cross sectional view and a front view of my invention.
Figure 3:
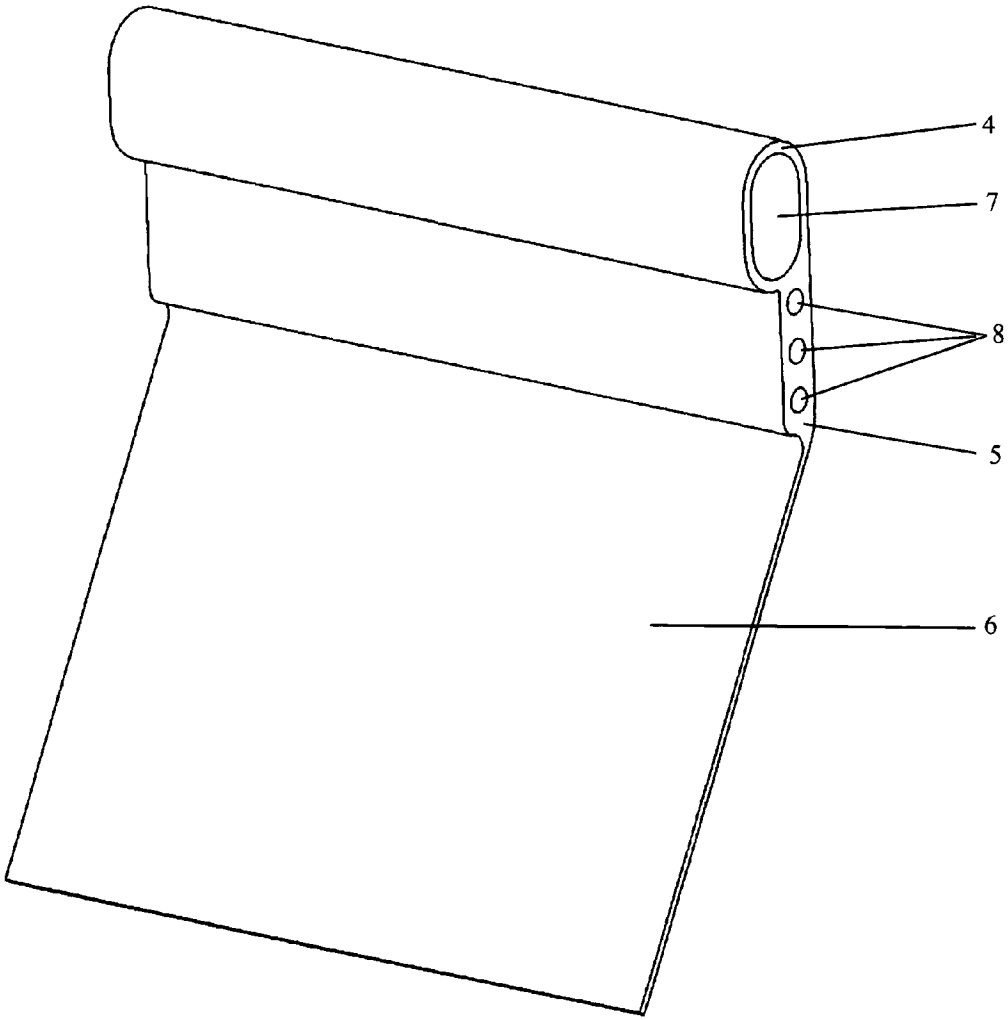
FIG. 3 is a three dimensional view of my invention
Figure 5:
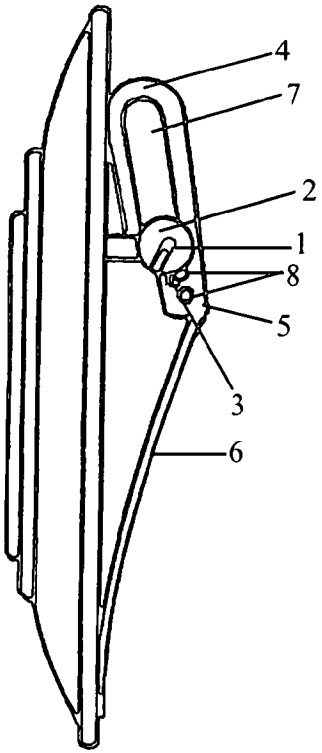

FIG. 5 is a view of my invention actively engaged on the back of the brooch. The pin of the brooch is inserted into the pin hole closest to the head of my invention. The head of the pin is now engaged in the locking device. The latch of the locking device is closed. The tail is flexed. The tail has been trimmed.

Figure 6:
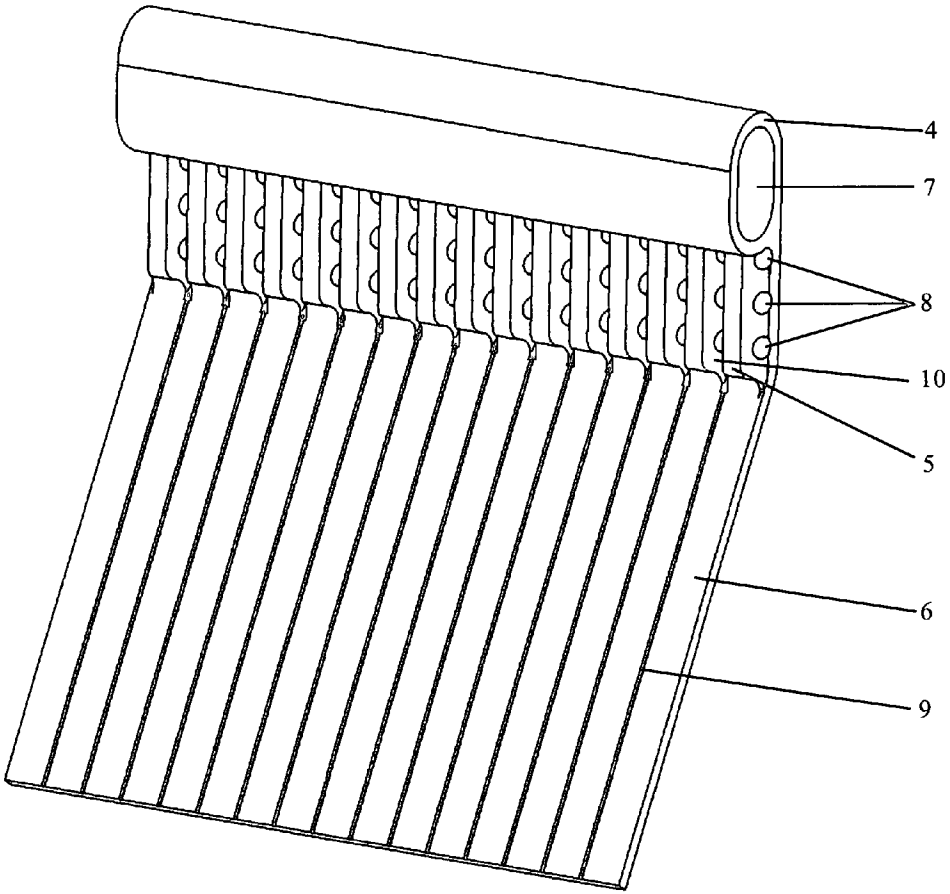

FIG. 6 is a three dimensional view of an alternate embodiment illustrating the addition of scribe lines on the tail to make it easier to get straight cut lines when the tail is trimmed. This view also illustrates "V" cuts on the body in line with the scribe lines on the tail to make it easier to cut through the body.

Figure 7:
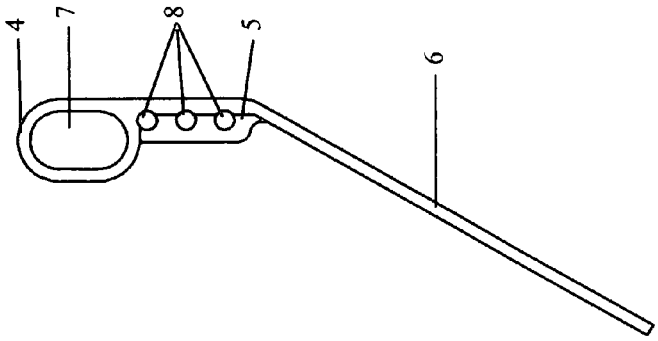
Figure 7:
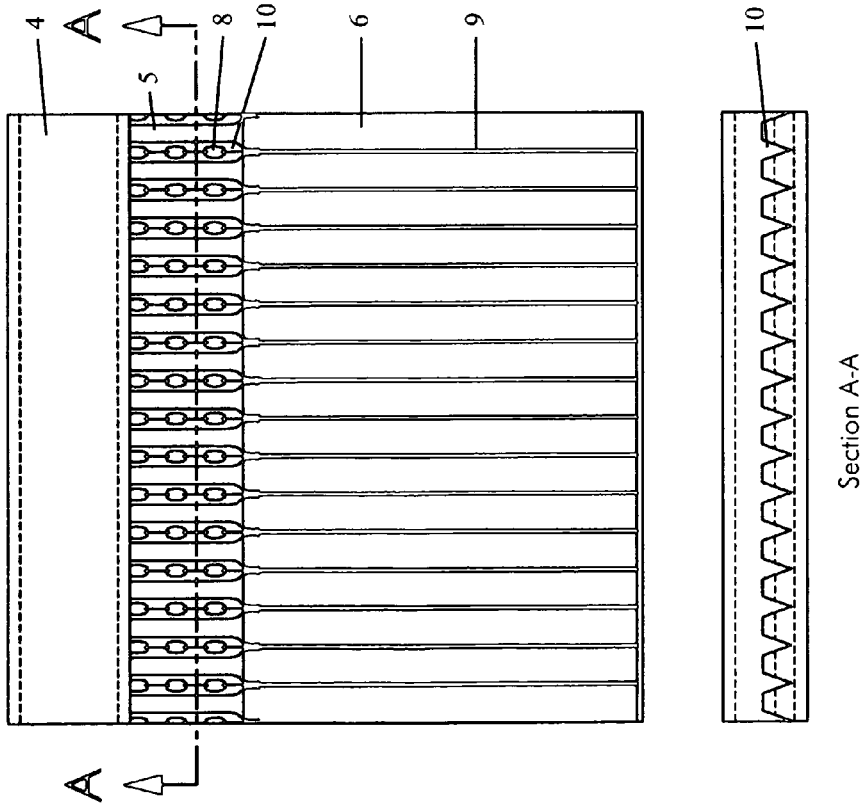

FIG. 7 is a cross sectional view of my invention showing the "V" cuts on the body.

Figure 8:
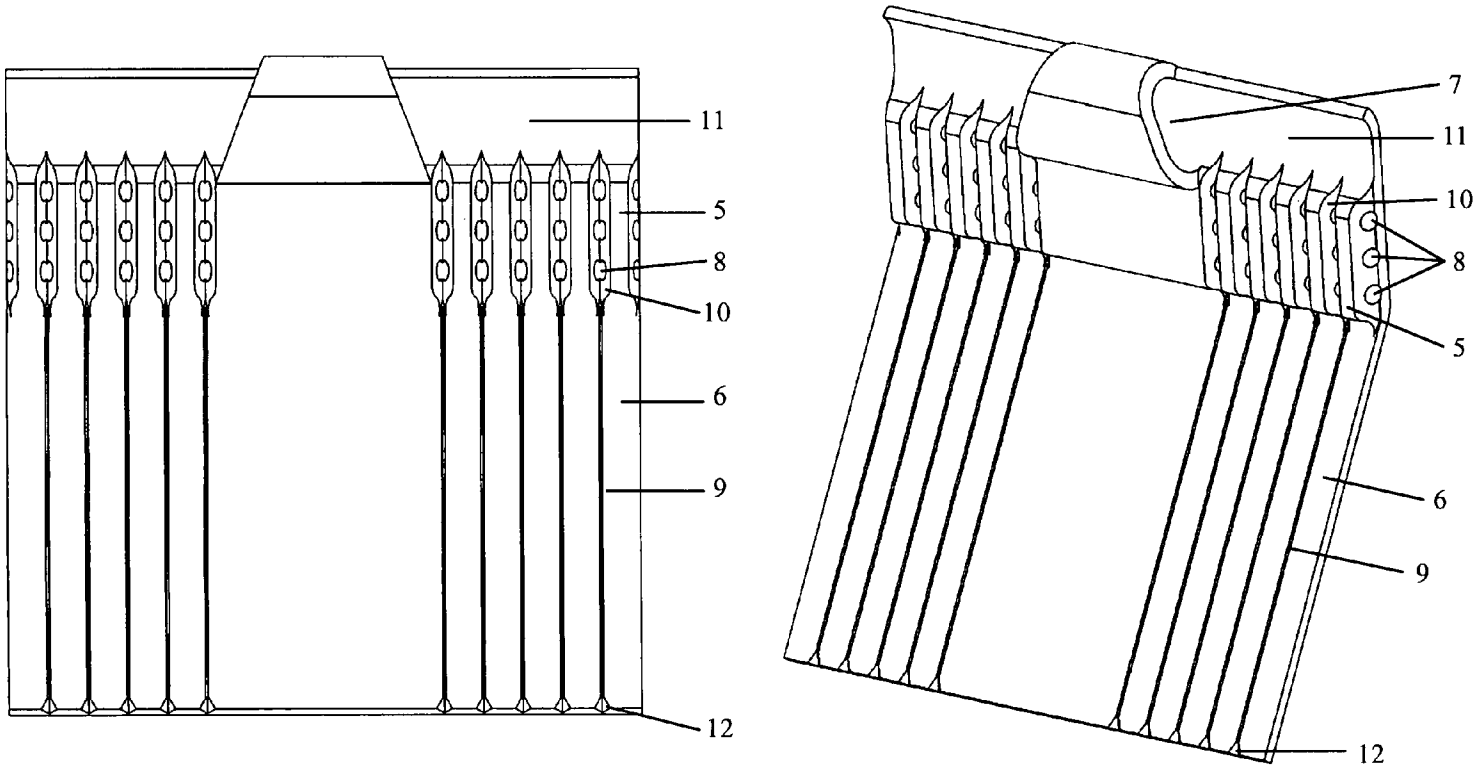

FIG. 8 is a view of an alternate embodiment illustrating a pre-cut head making it easier to cut through the head and trim it as needed. This view also illustrates notches at the end of each scribe line on the tail in order to make the beginning of each scribe line more visible.

Figure 9:
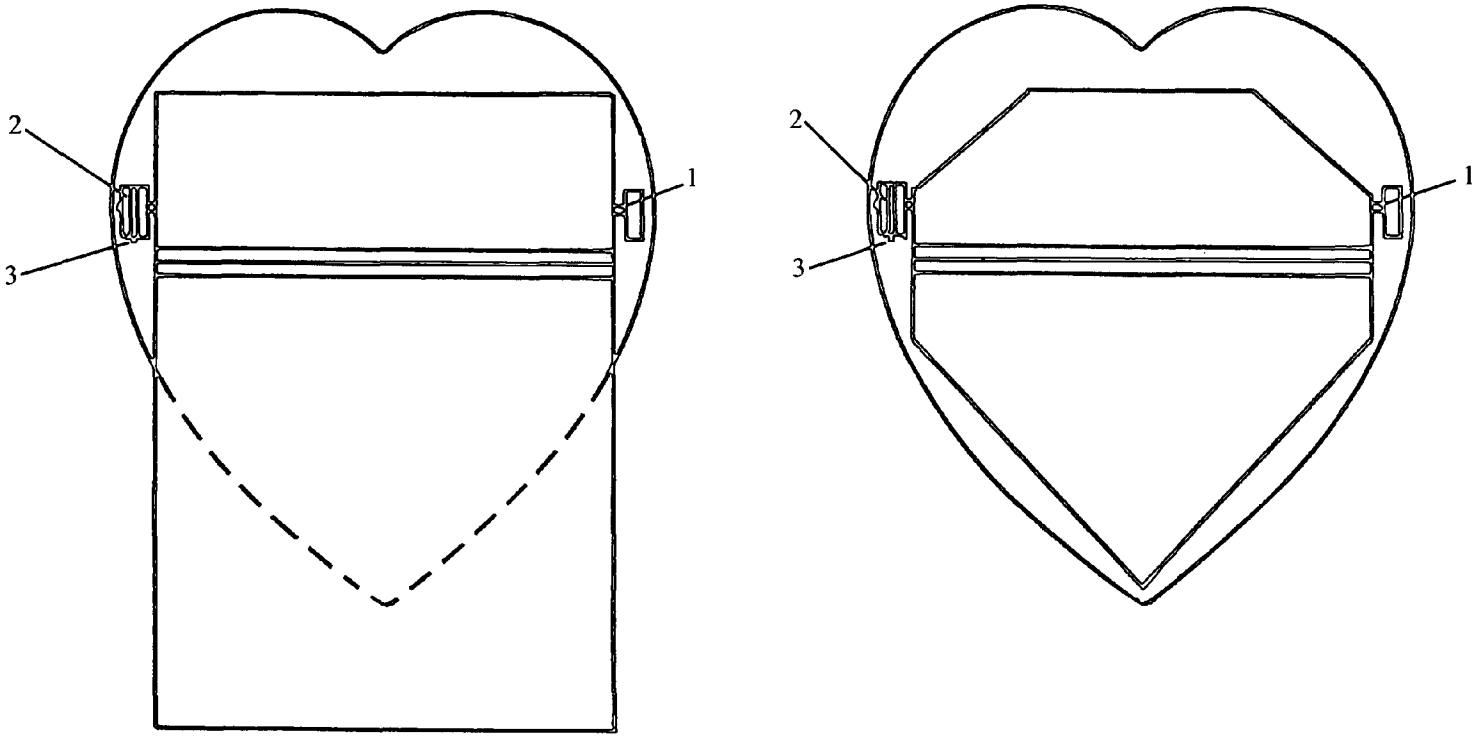

FIG. 9 is a view of my invention on the back of a brooch before it is trimmed to fit and a view of my invention on the back of a brooch after it is trimmed to fit.

DRAWINGS

List of Reference Numerals

1. Standard brooch with pin and locking device on the back
2. Locking device on the back of a standard brooch
3. Latch on the locking device on the back of a standard brooch
4. Head of my invention
5. Body of my invention
6. Tail of my invention
7. Necklace hole in the head of my invention
8. Pin holes in the body of my invention
9. Scribe lines in the tail of my invention
10. "V" cuts in the body of my invention
11. Pre-cut head of my invention
12. Notches at the end of the tail of my invention

DETAILED DESCRIPTION OF THE PREFERRED EMBODIMENT(S)

My invention is a unitary attachment made from a clear polymer that, when attached to a brooch, will allow that brooch to be worn as a pendant. A brooch is a piece of jewelry that is worn by pinning it on the clothing. A brooch has a pin 1 on the back that hinges open and closed. When the pin 1 is in the closed position the head of the pin is inserted into a slot in a locking device 2 and secured there with a latch 3.

My invention is made up of a head 4, a body 5, and a tail 6. The head 4 has a necklace hole 7 through which a necklace (a chord, chain, ribbon, rope or any similar material that will support the pendant) can pass. The body 5 has one or more pin holes 8 through which the pin on the back of the brooch 1 can pass. The tail 6 is thin and will flex easily.

When the pin on the back of the brooch 1 is inserted into one of the pin holes in the body of my invention 8 and the pin 1 is pushed down, up and into the slot of the locking device 2, the tail of my invention 6 must flex. The tendency of the tail 6 to return to a unflexed position will push the head of my invention 4 against the back of the brooch above the pin 1 and push the tail of my invention 6 against the back of the brooch below the pin 5. Because my invention is touching the back of the brooch above and below the pin 5, my invention cannot rotate about the pin 5, making it stable and secure.

My invention is then marked and trimmed so that no part of it shows from the front side of the brooch.

Alternative Embodiments

Because the head 4 and the body 5 of my invention must be stronger than the tail 6 so that they will not flex or collapse when the tail 6 flexes, they can be difficult to cut without special cutting instruments. And because I want my invention to be fully adjustable by anyone with a knife or a pair of household scissors, certain alternative embodiments of my invention must be considered.

1. Scribe lines 9 running length wise on the tail 6 make it easier to cut a straight line when trimming the width of my invention. Notches 12 at the base of the tail 6 identify the start of each scribe line 9, making it easier for those with poor vision to see where a scribe line 9 begins (FIGS. 6 & 7).

2. "V" cuts 10 through the body of my invention 5 in line with each scribe line 9 make it far easier to cut through the body 5 without sacrificing strength. The body 5 must not flex when the tail 6 flexes and the design of these "V" cuts 10 leave the body 5 with sufficient strength to resist flexure (FIGS. 6 & 7).

3. When adjusting the head 4, cutting through a double thickness of the polymer (the front and back walls of the head 4) is necessary. This would be very difficult with a knife or a pair of scissors. A pre-cut head 11 makes it possible to adjust the head 4 by cutting through only a single thickness of the polymer. The head 4 is left with enough strength to resist collapse when the tail 6 is flexed, while it is still fully adjustable (FIG. 8).

Conclusion, Ramifications, and Scope of the Invention

My invention provides a safe way to take those old but beautiful brooches out of storage and start to wear them as pendants. And you don't have to alter or damage those valuable brooches to do so. In the past, only a jewelry or similar craftsman could build an attachment that would allow you wear a brooch as a pendant. Today, with my invention, anyone with a knife or a pair of scissors can do it. And the attachment that makes this possible is virtually unnoticeable.

My invention is preferably made of a clear polymer. It attaches to the back of a brooch utilizing the pin on the back of the brooch. The flex of the tail stabilizes the attachment and prevents rotation about the pin. After the attachment is secure, a necklace is slipped through the hole in the head of my invention and the pendant is ready to wear.

The invention claimed is:

1. An attachment made of a polymer for converting a brooch with a horizontal mounting pin to a pendant to be suspended from a cord, necklace, or a chain, said attachment comprising a central body with multiple pin holes running parallel to a horizontal axis of said attachment, a head extending vertically upward from said body forming and containing a necklace hole which runs parallel to the horizontal axis of said attachment, said head extending the full width of the attachment, a tail extending vertically downward from said body at an angle toward a front of said attachment relative to a vertical axis of said attachment in cross section, said tail extending the full width of said attachment.

2. An attachment according to claim 1, said body has multiple equally spaced "V" shaped grooves cut in a front surface of said body, running parallel to the vertical axis of said attachment, whereby a line bisecting the angle formed by each said "V" shaped groove is perpendicular to the horizontal axis of said attachment.

3. An attachment according to claim 1, said tail has multiple scribe lines on a front surface of said tail with a notch at a base of each said scribe line, whereby each said scribe line runs parallel to each other and is aligned with a base of the corresponding said "V" shaped groove.

4. An attachment according to claim 1, further comprising a broad flat plane located on the back of said attachment that will lay against a chest of a wearer of the attachment, said flat plane encompassing the back of said body and said head, extending horizontally the full width of said attachment.

* * * * *